US006810127B2

(12) United States Patent
Bronson, III

(10) Patent No.: US 6,810,127 B2
(45) Date of Patent: Oct. 26, 2004

(54) CLEAR SOUND SIDE FILL CENTER FILL

(76) Inventor: Andrew P Bronson, III, 1956 Pratt St., Philadelphia, PA (US) 19124

( * ) Notice: Subject to any disclaimer, the term of this patent is extended or adjusted under 35 U.S.C. 154(b) by 0 days.

(21) Appl. No.: 10/397,336

(22) Filed: Mar. 26, 2003

(65) Prior Publication Data

US 2004/0052393 A1 Mar. 18, 2004

Related U.S. Application Data

(63) Continuation of application No. 29/167,523, filed on Sep. 16, 2002.

(51) Int. Cl.[7] ..... H04R 25/00

(52) U.S. Cl. ..... 381/345; 381/334; 381/335; 381/336; 381/386; 181/197; 181/199

(58) Field of Search ..... 381/334, 335, 381/336, 339, 341, 349, 350, 351, 386, 345; 181/197–199, 189, 190, 154, 178, 179, 186

(56) References Cited

U.S. PATENT DOCUMENTS 1,303,441 A * 5/1919 Wilton ..... 217/60 C
3,060,546 A * 10/1962 Nelson ..... 27/18
4,031,318 A * 6/1977 Pitre ..... 381/386
4,139,734 A * 2/1979 Fincham ..... 381/335
4,524,496 A * 6/1985 Tehsildar et al. ..... 27/18
4,757,544 A * 7/1988 Guy ..... 381/387
4,815,559 A * 3/1989 Shirley ..... 181/144
5,484,092 A * 1/1996 Cheney ..... 224/404
5,516,168 A * 5/1996 Tomaszewski-Link ..... 292/338
5,546,468 A * 8/1996 Beard ..... 381/86
5,570,493 A * 11/1996 Gulick ..... 27/18
5,758,852 A * 6/1998 Martin ..... 248/282.1
5,819,959 A * 10/1998 Martin ..... 211/118
5,872,340 A * 2/1999 Anagnos et al. ..... 181/199
6,343,133 B1 * 1/2002 Adamson ..... 381/340
6,628,796 B2 * 9/2003 Adamson ..... 381/342
6,652,046 B2 * 11/2003 Christner ..... 312/111
6,668,422 B2 * 12/2003 Tolmei ..... 16/82

* cited by examiner

*Primary Examiner*—Huyen Le
*Assistant Examiner*—Dionne Harvey

(57) ABSTRACT

A loud speaker enclosure being made in two parts with each of the side panels cut into angle form to assist in angle adjustment, alone with pivot hinges and friction lid supports used to hold it's angled position. The enclosure can be modified to accommodate any design or style of drivers boards. In addition to any design of loudspeaker, any orientation of enclosing may be incorporated with this invention. This enclosure can be used without driver board 5B were by Box B would then operate as an angling base for Box T.

6 Claims, 4 Drawing Sheets

A B

B

A

CLEAR SOUND SIDE FILL CENTER FILL

CROSS-REFERENCE TO RELATED APPLICATIONS

This is a continuation of application No. 29/167,523 Filing Date Sep. 16, 2002.

FEDERALLY SPONSORED RESEARCH

Not Applicable

SEQUENCE LISTING OR PROGRAM

Not Applicable

BACKGROUND OF THE INVENTION

1. Field of Invention

This invention relates to loudspeaker enclosures, which are used for PA sound reinforcement.

2. Background of the Invention

Pro Audio manufactures and retailers supply sound engineers, musicians, stadiums and concert halls with loudspeakers and enclosures to be used during large gatherings to ensure that each member of the audience can hear the event or program they are attending.

Originally these loudspeaker enclosures were made as a straight up right box used to keep the loud speaker from canceling itself out. U.S. Pat. No. 3,862,366 Huszty Etal (1975). However, as times changed and larger crowds gathered the need for bigger and better looking enclosure grew along with better performance being the key functions.

Thereafter, the inventors have attempted to create enclosures that are stylish and attractive looking, but unfortunately looks are a major concern when it comes to the spectators line of sight during a concert event. U.S. Pat. No. 6,122,386 to Wiley (2000) discloses an enclosure that is adjustable and is elevated above the spectators line of sight, but there is still some clutter in the spectators line of site. For example the poles the enclosures are placed upon and the speaker cables used to feed the signal to the loudspeaker are also in sight. During an event were there is a lot of movement and strong vibration of sound this method could become unstable and possibly endanger spectators and performers. In the case of space on stage being a major concern this enclosure can prove to be un useful because it takes up a lot of space. U.S. Pat. No. 6,101,261 to Brown, Samuel (2000) discloses an enclosure that is adjustable from a angle point of view. Although this is a great idea it is limited to operating as an enclosure and only achieves 45–90 degree angles of sound projection. This invention can't be used in all matters of sound reinforcement.

BACKGROUND OF INVENTION—OBJECTS AND ADVANTAGES

My invention has a number of advantages over the above patents and prior arts.

(a) Operates as a side fill and a center fill enclosure.

(b) The claims of this enclosure can be incorporated into a design for a drum fill or a drum wedge.

(c) Safe and stable method of operation. There is no danger of this enclosure falling over during the event.

(d) Invention does not block spectator view of event.

(e) Easy vertical angle adjustment.

(f) Multiple vertical angle adjustment.

(g) Invention provides the sound of a full size enclosure is a smaller design that does not require a lot of space.

(h) Any design of driver board can be incorporated.

(i) Box B can also be used as an angle adjustment base utilized by loud speakers being enclosed in box T.

SUMMARY OF INVENTION

Before explaining several preferred embodiments of the invention in detail, it is to be understood that the invention is not limited in its application, details, construction or to the arrangement of the components that are in the following description and illustrated in the drawings. The invention of this loudspeaker enclosure is capable of other embodiments of PA sound reinforcement.

Those skilled in the art will appreciate the conception, of which this disclosure is based and may be utilized as a basis for designing other structures using the same methods of operation being used by this new invention of a loudspeaker enclosure.

This invention is not designed with any particular size, measurements or angles in mind. But its order of operation remains the same. However depending upon the size and characteristics of the loudspeakers being enclosed, greater angles of sound projection may be achieved, enhancing the abilities of the named invention. This invention can also be incorporated with any style of driver board. With respect to Box B, it can be used as a base used to support Box T in its angle projection of sound Simply by not including any ornamental design on panel 5B.

While working as a sound technician various limitations were noted not just on stage but in front house as well. My invention can be incorporated were overhead tress and catwalks are not available whereby alleviating the need of hanging enclosures above spectators.

The operation of my invention being disclosed in this application can be applied were stadiums and concert venues seating arrangements are made on an incline and the stage is in a low position.

DRAWINGS—FIGURES

Figure 1:
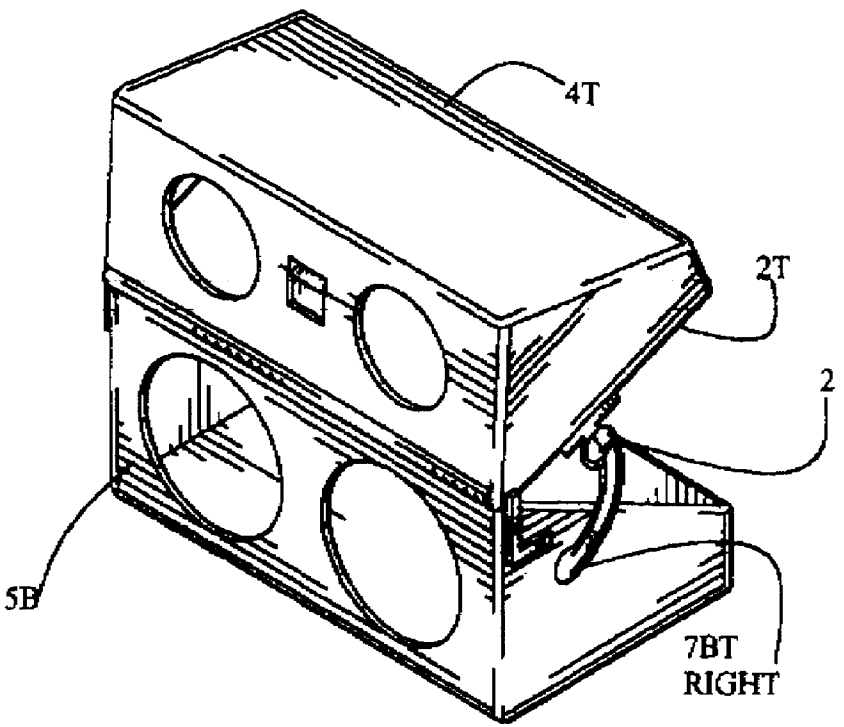
FIG. 1 is a perspective view of my new design showing A without panel 5B driver board and B with driver board 5B, Flat Corner Braces and Friction Lid Supports.
Figure 1:
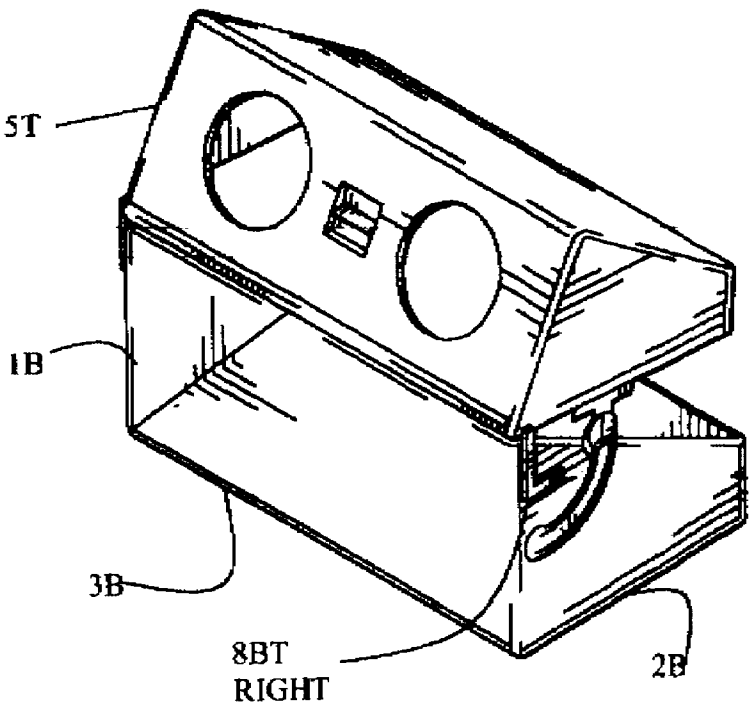

The top and bottom panel boards of box T and B have no ornamental design.

DRAWINGS

Reference Numerals

| Bottom box B | Top box T |
|---|---|
| 1B Left Panel board | 1T Left Panel board |
| 2B Right Panel board | 2T Right Panel board |
| 3B Bottom Panel board | 3T Bottom Panel board |
| 4B Top Panel board | 4T Top Panel board |

-continued

| Bottom box B | Top box T |
|---|---|
| 5B Driver board | 5T Driver board |
| 6B Rear Panel board | 6T Rear Panel board |

UN invented Hard Ware Utilized in the invention.

7BT Friction Lid Support Left and Right side-1, 2 Locking Screws

8BT Corner Braces Left and Right side

9T Angle Griping Handle

DESCRIPTION OF THE PREFERRED EMBODIMENT

Figure 2:
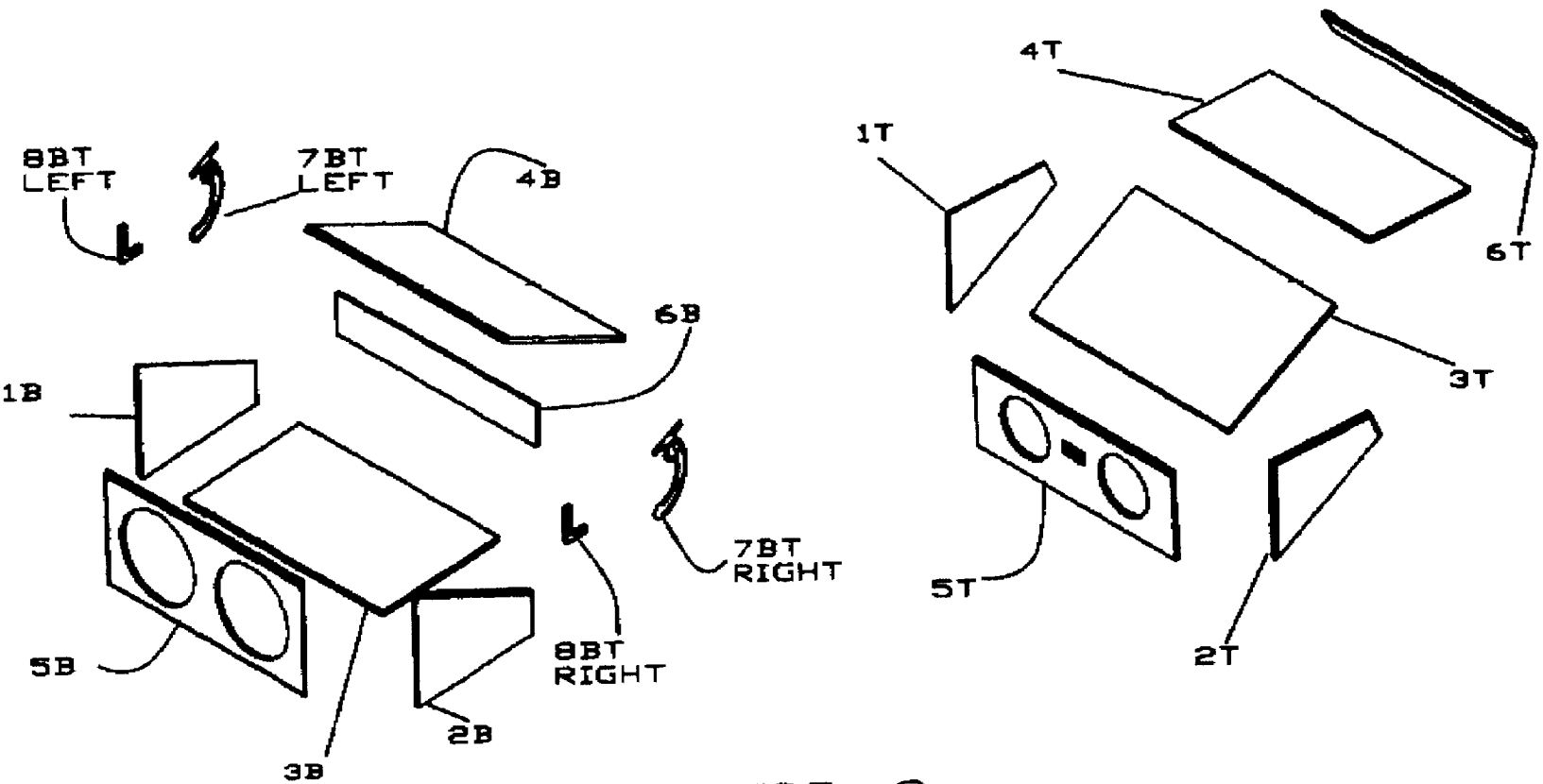
FIG. 2 is an exploded view of my new design for a loudspeaker enclosure.

Referring now to the drawings of the FIG. 2 being disclosed. The corresponding parts throughout FIG. 2 are described as follows. FIG. 2 consists of an exploded view exposing all embodiments of the invention.

Referring to the bottom box B starting with panel 3B left edge is joined to the inside low edge of 1B and the right edge of 3B being joined to the inside low edge of 2B. Panel 6B out side left edge is joined to 1B inside rear edge while it's right edge is joined to 2B inside rear edge and 6B bottom edge is also joined to 3B inside rear edge, with all edges being lined up evenly.

Panel 4B outside left edge is joined to 1B top inside edge and 2B inside top edge with its rear outside edge joined to 6B top inside edge. Panel 5B out side edges are joined to the inside front edges of panels 1B, 2B, 3B and 4B completing the assembly of box B.

Referring to the top Box T starting with panel 3T left edge is joined to the inside low edge of 1T and the right edge of 3T being joined to the inside low edge of 2T. Panel 6T outside left edge is joined to 1T inside rear edge while it's right edge is joined to 2T inside rear edge and 6T bottom edge is also joined to 3T inside rear edge, with all edges being lined up evenly. Panel 4T outside left edge is joined to 1T top inside edge and 2T inside top edge with it's rear outside edge joined to 6T top inside edge. Panel 5T outside edge are joined to the inside front edges of panels 1T, 2T, 3T and 4T completing the assembly of box T.

Figure 4:
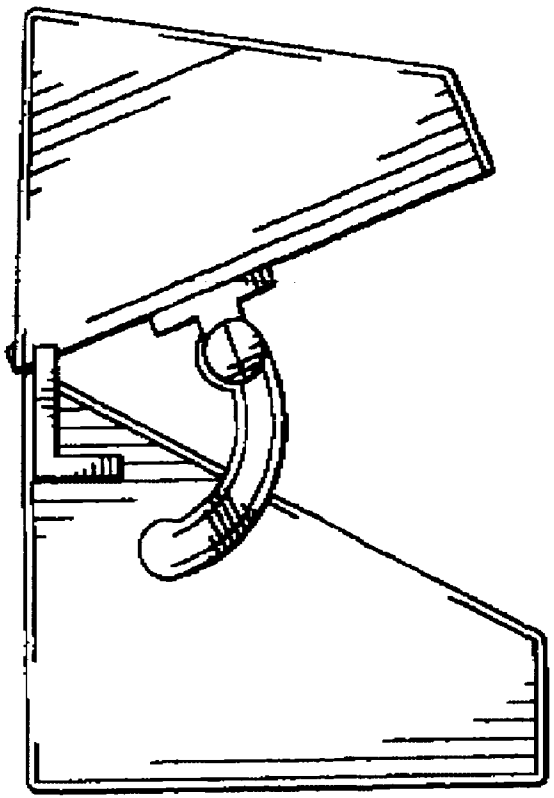
FIG. 4 is a right side view of my new design for a loudspeaker enclosure in an upright position with Flat Corner Braces and Friction Lid Supports. The left side is a mirror image of this view.
Figure 3:
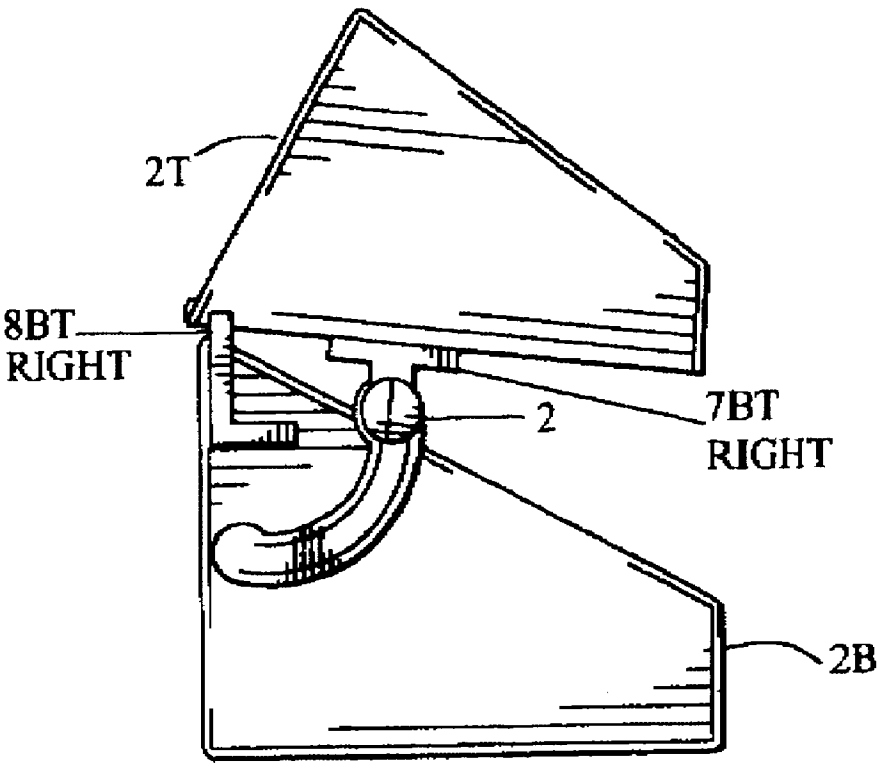
FIG. 3 is a right side view of my new design for a loudspeaker enclosure in its angled position, with Flat Corner Braces and Friction Lid Supports. The left side is a mirror image of this view.
Figure 5:
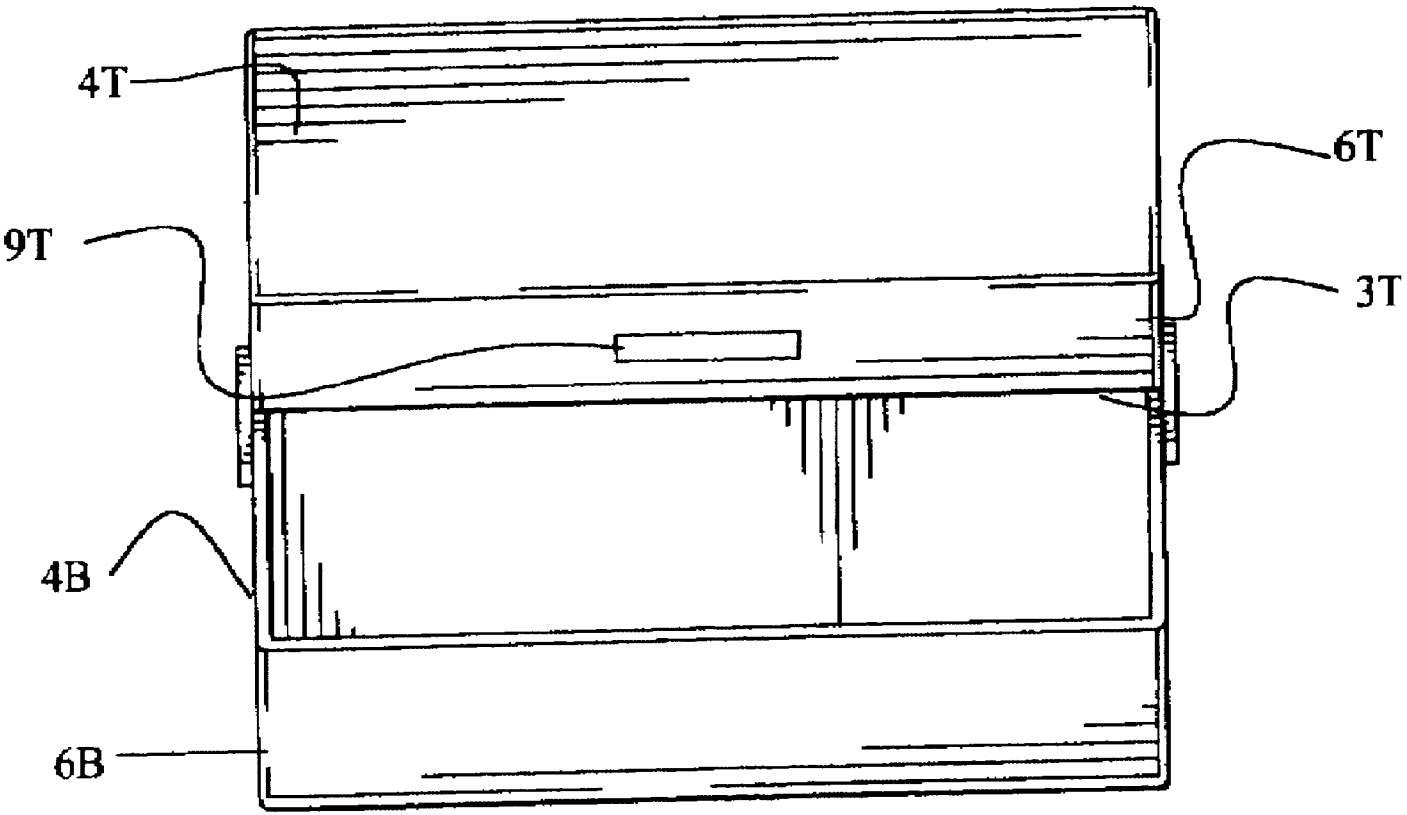
FIG. 5 is a rear view of my new design for a loudspeaker enclosure.

Referring to FIGS. 3 and 4 box B and T are joined together at the far outside edges using Corner Braces 8BT Being placed on the left and right side of the said invention. Friction Lid Supports are placed of center of FIGS. 3 and 4 to allow for a certain level of angle adjustments.

What is claimed is:

1. An angle adjustable loudspeaker enclosure that is designed to operate as a side fill and a center fill, and being made in two parts wherein a first part of the angle adjustable loudspeaker enclosure comprises:

a box-b, which includes a driver board, a left side panel and a right side panel, and wherein each side panel is mounted to opposing sides of said driver board thereby forming front corners for said first part;

and wherein box-b may be used as an enclosure for sub-frequency audio signal reproduction, and as an angle-adjusting base;

the second part of the angle adjustable loudspeaker enclosure comprising:

a box-t, which operates as a three-way enclosure using said first part to accomplish its angular direction of said reproduced audio signal; said three-way enclosure pivoting by using flat corner braces which are at least partially attached to said front corners of said first part;

box-t co-operating to be rotatably adjustable with respect box-b thereby achieving different angles; said different angles of the angle adjustable loudspeaker enclosure being held in place by at least a first and a second adjustable friction-lid support;

an adjustable friction-lid support comprising:

a proximal end provided with a top-mounting bracket;

and a distal end provided with a bottom-mounting portion;

said proximal and distal ends being connected by a curved arm having an inner-side and an outer-side;

the adjustable friction-lid support being constructed such that it does not include predetermined location notches and being mounted in the center of the angle adjustable loudspeaker enclosure with the inner-side of the curved arm facing a front side of the angle adjustable loudspeaker enclosure;

the first and second adjustable friction-lid supports being connected to said angle adjustable loudspeaker enclosure;

at least one means for mounting, wherein the at least one means for mounting attaches the bottom-mounting portion of the first adjustable friction-lid support to the left-side panel of box-b, and wherein another at least one means for mounting attaches the bottom-mounting portion of the second adjustable friction-lid support to the right-side panel of box-b;

and wherein the top-mounting-bracket of said first and second adjustable friction-lid support is mounted to a bottom panel of box-t;

said first and second adjustable friction-lid supports operating to rotatably adjust the angle of the reproduced audio signal from the angle adjustable loudspeaker enclosure in a lockable manner by one of loosening or tightening of a locking screw;

said locking screw being disposed proximate the center of said top-mounting bracket;

and whereby a gripping handle is provided in a center of a rear panel of box-t to allow for manual adjustment of said different angles.

2. A article of sound reinforcement comprising the combination of claim 1 for projection of sound at various angles without blocking a spectators line of site, said speaker enclosure made for reproducing angled sound projection for use by audio professionals and for permitting an unobstructed line of sight by spectators, wherein the first part of said angle adjustable loud speaker enclosure is stationary.

3. An angle adjustable loudspeaker enclosure comprising the combination of claim 2 wherein box-t provides full range frequency sound reproduction.

4. An angle adjustable loudspeaker enclosure comprising the combination of claim 3 wherein box b and box-t are combined at front-top edges of box-b and front-bottom edges of box-t, being placed evenly with one another.

5. An angle adjustable loudspeaker enclosure comprising the combination of claim 4 wherein the right and left side panels of box-b are constructed using angular dimensions such that box-b will assist in the angular projection of reproduced sound from said enclosure.

6. An angle adjustable loudspeaker enclosure comprising the combination of claim 5 wherein box-t is constructed to include right and left side panels; and wherein the right and left side panels of box-t are constructed using angular dimensions such that box-t will accommodate at least one speaker being integrated for the purpose of assisting in the angular projection of reproduced sound from said enclosure.

* * * * *